US006547648B1

(12) United States Patent
Zhu et al.

(10) Patent No.: US 6,547,648 B1
(45) Date of Patent: Apr. 15, 2003

(54) METHOD AND DEVICE FOR HIGH SPEED ELECTROLYTIC IN-PROCESS DRESSING FOR ULTRA-PRECISION GRINDING

(75) Inventors: Zhenqi Zhu, Holmdel, NJ (US); Xiaoming Liu, Jersey City, NJ (US)

(73) Assignee: Trustees of Stevens Institute of Technology - Graduate School and Research Services, Hoboken, NJ (US)

( * ) Notice: Subject to any disclaimer, the term of this patent is extended or adjusted under 35 U.S.C. 154(b) by 58 days.

(21) Appl. No.: 09/687,548

(22) Filed: Oct. 13, 2000

Related U.S. Application Data

(60) Provisional application No. 60/159,781, filed on Oct. 15, 1999.

(51) Int. Cl.[7] ..... B24B 1/00; B24B 7/00

(52) U.S. Cl. ..... 451/49; 451/56; 451/72; 451/443

(58) Field of Search ..... 125/11.01, 11.02, 125/11.18, 11.19; 451/21, 22, 49, 56, 72, 443

(56) References Cited

U.S. PATENT DOCUMENTS

| | | | | |
|---|---|---|---|---|
| 3,823,515 A | * | 7/1974 | Coes, Jr. | 451/53 |
| 5,833,520 A | * | 11/1998 | Kanda et al. | 125/11.04 |
| 5,868,607 A | | 2/1999 | Enomoto et al. | 451/56 |
| 6,110,019 A | * | 8/2000 | Ohmori | 451/443 |
| 6,149,504 A | * | 11/2000 | Ohmori et al. | 451/36 |
| 6,217,423 B1 | * | 4/2001 | Ohmori et al. | 451/262 |
| 6,244,939 B1 | * | 6/2001 | Ohmori et al. | 451/443 |

FOREIGN PATENT DOCUMENTS

| | | | |
|---|---|---|---|
| JP | 1-153256 | * | 6/1989 |
| JP | 4-8476 | * | 1/1992 |

OTHER PUBLICATIONS

Bandyopahyay, B. P., "Ultra–Precision and High Efficiency Grinding of Structural Ceramics by Electrolytic in–process Dressing (Elid) Grinding", *Abrasives* 1997 Apr./May 10–34.

Bandyopahyay et al., "Efficient and stable grinding of ceramics by electrolytic in–process dressing (ELID)", *J. Material Proc. Tech.* 1997 66:18–24.

Bifano et al., "Fixed–Load Electrolytic Dressing with Bronze Bonded Grinding Wheels", *Med–vol. 2–1/MH–vol. 301, Manufacturing Science and Engineering ASME* 1995 329–348.

Chi et al., "Hydromechanical Lubrication", *National Defense Press, Sep. Beijing* 1998.

Inasaki et al., "Abrasive Machining in the Future", *Annals of the CIRP* 1993 42(2):723–731.

Jahanmir et al., *NIST Special Publication* 1992.

Kloke et al., "High–Speed Grinding–Fundamentals and State of the Art in Europe, Japan, and the USA", *Annals of the CIRP* 1997 46(2):715–724.

Komanduri et al., *Annals of the CIRP* 1997 46(2).

Kovacevic, R. et al., "High–Speed Water Jet as a Coolant/Lubricant in Grinding", *Abrasives* 1997 Jun./Jul. 10–30.

Lee and Kim, "A Study on the Analysis of Grinding Mechanism and Development of Dressing System by Using Optimum In–Process Electrolytic Dressing", *Int. J. Mach. Tools Man.* 1997 37(12) 1673–1689.

(List continued on next page.)

*Primary Examiner*—Timothy V. Eley
(74) *Attorney, Agent, or Firm*—Licata & Tyrrell P.C.

(57) ABSTRACT

This invention is a process and device for high speed electrolytic in-process dressing (HELID). The device of the present invention may be provided as an add on to an existing grinding machine or may be integrated into a grinding machine as a subsystem. Grinding machines which are subject to the present invention include, but are not limited to, surface, cylindrical, centerless and double-disk grinding machines.

11 Claims, 1 Drawing Sheet

OTHER PUBLICATIONS

Ohmori and Nakagawa, "Mirror Surface Grinding of Silicon Wafers with Electrolytic In–Process Dressing", *Annals of the CIRP* 1990 39(1):329–332.

Ohmori and Nakagawa, "Utilization of Nonlinear Conditions in Precision Grinding with ELID (Electrolytic In–Process Dressing) of the Fabrication of Hard Material Components", *Annals of the CIRP* 1997 46(1) 261–264.

Ohmori et al., "Analysis of Mirror Surface Generation of Hard and Brittle Materials by ELID (Electronic In–Process Dressing) Grinding with Superfine Grain Metallic Bond Wheels", *Annals of the CIRP* 1995 44(1) 287–290.

Salmon, S., "Abrasives Technology–Next Generation Processes Require Next Generation Machine Tool Technology", *World Scientific* 1997 126–133.

Suzuki et al., "Development of a Simplified Electrochemcial Dressing Method with Twin Electrodes", *Annals of the CIRP* 1991 40(1):363–366.

Westkamper and Tonshoff, "CBN or CD Grinding of Profiles", *Annals of the CIRP* 1993 42(1):371–374.

Malkin, *Ellis Horwood Limited* 1989.

Salmon, S. *Modern Grinding Process Technology*, McGraw Hill 1992.

* cited by examiner

METHOD AND DEVICE FOR HIGH SPEED ELECTROLYTIC IN-PROCESS DRESSING FOR ULTRA-PRECISION GRINDING

This application claims the benefit of provisional U.S. application Ser. No. 60/159,781, filed Oct. 15, 1999.

FIELD OF THE INVENTION

The invention is useful for high speed electrolytic in-process dressing (HELID) or sharpening of grinding wheels, especially diamond or CBN wheels. Grinding is the dominant machining process to achieve high precision and is widely used in various industries to produce precision metal and ceramic parts. The device and process of the present invention is useful for sharpening of fixed abrasive tools without stop and slow down of a machining process. The device is compact, low-cost and user friendly.

BACKGROUND OF THE INVENTION

The role of grinding processes in industry is becoming more and more important due to the increasing need for cost-effective machining of semiconductor materials with nano-precision such as super large and super-flat silicon wafers (Abe et al. *Proceedings of JSPE* 1998 *Spring Conference* 1998.471–472), and the high-speed machining of hard-to-machine materials including advanced ceramics, super-alloys, and composites (Kovach, et al. *ONRL/TM-*13562 1997.102–107). Usually carried out at around 30 m/s, grinding processes have been pushed toward nano-precision and high-speed ranging from 100 to 350 m/s to increase the productivity and quality of industrial products cost-effectively (Salmon, *World Scientific* 1997.126–133; Inasaki, *Annals of the CIRP* 1993.42(2) :723–731; Komanduri, *Annals of the CIRP* 1997.46(2):97). The field of grinding has expanded from classical finishing-machining to highly efficient machining in Japan, Europe and the USA (Kloke et al. *Annals of the CIRP* 1997. 46(2):715–723).

Traditionally, grinding wheels have been consumed in the grinding process usually by being ground or cut away by wheel sharpening dressers. As much as 90% of the grinding wheel materials can be lost during dressing, leaving only 10% of the wheel materials to be used in grinding (Kovacevic, *Abrasives,* 1997.June/July:10–25). Most of the grinding energy is consumed in rubbing the surface of a work piece by a dull grinding wheel, instead of cutting the surface clearly (Malkin, *Ellis Horwood Limited,* 1989; Salmon, *Modern Grinding Process Technology,* McGraw Hill, 1992). Wheel consumption accounts for about 60% of the grinding cost of steel materials using CBN wheels (Westkamper and Tonshoff, *Annals of the CIRP* 1993. 42(1) :371–374). As reported by NIST, the grinding cost of ceramic materials may reach up to 75% of the total component cost mainly due to excessive wheel consumption and excessive time spent on grinding the hard-to machine-materials (Jahanmir et al. *NIST Special Publication* 1992.834).

The majority of grinding wheels are being dressed with conventional dressers including single-point diamond, multi-point diamond, crush roll and diamond roll. Abrasive dressing sticks are also used. For many grinding machines, dressing may be time consuming due to the need to stop the grinding process or slow the wheel down to a required speed and slowly feeding the dresser.

In-process dressing can be carried out by equipping the grinding machines with accurate and expensive in-process dressing devices. However, inconsistent dressing and an unstable layer on grinding wheel surfaces are still serious problems to overcome. The wear of a dresser and the skill of an operator are also factors causing inconsistent dressing. As a result, inconsistent surface finish, and form and size inaccuracies are commonly found on ground workpieces. Traditional dressing and grinding processes are regarded as temperamental and depend greatly on operator skills. Methods have been developed for automatic and consistent sharpening of grinding wheels. ELID or electrolytic in-process dressing method is one of the latest promising dressing methods (Ohmori and Nakagawa, *Annals of the CIRP* 1990.39(1)(90):329–332). An ELID system consists of an electric conductive cast-iron fiber bonded (CIFB) grinding wheel as an anode, a copper or graphite cathode, and a power unit. When the wheel is subjected to a weak DC pulse current in an aqueous alkaline electrolyte, rusting of the wheel surface is promoted. The strong cast-iron bond will be turned into rather soft oxides and form a layer with poor electric conductivity. As the layer forms on the wheel surface, the current will become smaller, consequently, electrolysis of the iron bond will be suppressed to a minimum. As the grinding proceeds, chips of the materials being ground dispense the layer and make it thinner. Then, ELID current flow will resume. Subsequent increase in ELID current will attack the iron bond, turn it into the oxide layer and leave new protrusions of the diamond grains. The process continues during the whole period of ELID grinding, regardless of the grain size. Over the past ten years, ELID grinding has been studied intensively in Japan (Ohmori and Nakagawa, *Annals of the CIRP* 1990.39(1) (90) :329–332; Ohmori et al. *Annals of the CIRP* 1995.44 (1):287–290; Ohmori and Nakagawa, *Annals of the CIRP* 1997.46(1):261–264; Suzuki, *Annals of the CIRP* 1991.40 (1):363–366; Enomoto and Shimazaki, U.S. Pat. No. 5,868, 607). The consistency and efficiency of ELID grinding have been recognized internationally, (Inasaki et al. *Annals of the CIRP* 1993.42(2):723–731; Salmon Advances in Abrasive Technology, *World Scientific* 1997.126–133; Lee and Kim, *Int. J. Mach. Tools Manufact.* 1997.37(12) :1673–1689; Bandyopahyay, *Abrasives* 1997.April/May:10–34; Bandyopahyay, ONRL/SUB/96-SV16/1 1997.1–65; Zhang et al. "Grinding of GS-44 Silicon Nitride Using Both Vitrified and CIFB Diamond Wheels, Cost-Effective Ceramic Grinding: The Effect of Machine Stiffness on the Grinding of Silicon Nitride" DE-AC05-96OR22464:SU366-19, 1996; Bifano et al. *Manufacturing Science and Manufacturing* 1995., Med-Vol. 2-1/MH vol. 3-1:329–348). However, the consistency and efficiency of ELID grinding are only realized at a low surface speed of about 20 m/s and no higher than 30 m/s. The dressing efficiency drops when the wheel surface speeds are larger than the effective surface speeds. Therefore, a dull grinding wheel can no longer be sharpened and efficient grinding cannot be realized. ELID systems also prove to be ineffective due to decreasing dressing current, with wheel speed increases. Such a low dressing current indicates a high resistance due to insufficient electrolyte in the dressing zone. The insufficient electrolyte along the dressing zone is caused by air film surrounding the wheel, voids behind protrusions, leaking of fluid in transverse direction, and centrifugal force as the wheel speed increases.

The present invention provides a new device for realizing electrolytic in-process dressing of grinding wheels at high grinding surface speeds with quasi-static foil electrode and film terminals. The electrolytic in-process dressing grinding has never before been realized at high speeds. The instant invention also provides a high-speed electrolytic in-process dressing (HELID) method for sharpening superabrasive grinding wheels consistently using electrolytic in-process dressing to realize high-speed ultra-precision grinding.

SUMMARY OF THE INVENTION

A device for high speed electrolytic in-process dressing (HELID) comprising an electrical conductive foil electrode, an electrical conductive bond grinding wheel, an electrolytic fluid supply and a power source is provided. Also provided is a method for using the HELID for sharpening grinding wheels comprising rotating a grinding wheel at a desired speed while supplying electrolytic fluid between the wheel surface and a foil electrode thereby allowing the foil to wrap around the grinding wheel by way of hydrodynamic forces to form a thin hydrodynamic film bearing between the wheel surface and the traveling foil.

DETAILED DESCRIPTION OF THE INVENTION

Figure 1:
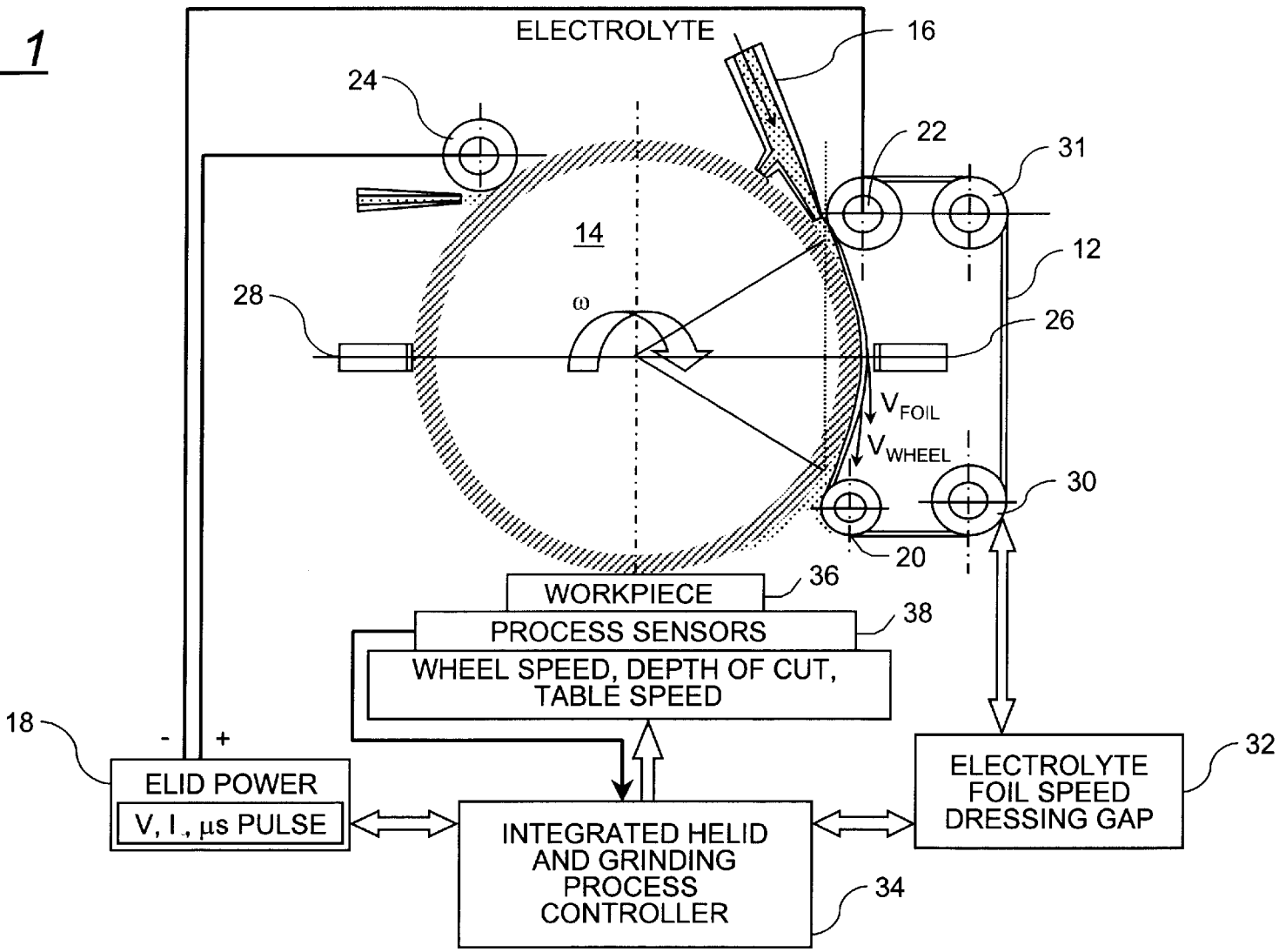
FIG. 1 shows a HELID grinding device with a moving-foil electrode.

The present invention provides a process and device for for high speed electrolytic in-process dressing (HELID) comprising an electrical conductive flexible electrode, an electrical conductive bond grinding wheel, an electrolytic fluid supply and a power source. The process is useful for sharpening of grinding wheels. The device of the present invention may be provided as an add-on to an existing grinding machine or may be integrated into a grinding machine as a subsystem. Grinding machines which are subject to the present invention include, but are not limited to, surface, cylindrical, centerless and double-disk grinding machines.

FIG. 1 shows one embodiment of the high speed dressing and grinding device 10 which comprises an electrical conductive flexible electrode 12 which may be foil or flexure; an electrical conductive bond grinding wheel 14; an electrolytic fluid supply 16; and a power source 18. The quasi-static foil electrode 12 is preferably flexible and forms a closed loop around a group of bearing rollers 20, 22, 30 and 31. The bond of the grinding wheel 14 is conductive, such as metal bonded super-abrasive wheels with a high stiffness suitable for precision grinding of ceramics and alloys. The grinding wheel 14 is in contact with the work piece 36. A means for controlling the speed of the flexible electrode 30 is provided. As the wheel speed increases, the electrode speed increases. A means for regulating the tension 31 of the closed loop is provided. Gap sensors 26 and 28, are present which self adjust to keep the gap at a desirable constant. A motorized flexible electrode may also be used in the present invention. Process Sensors 38 provide information about wheel speed, depth of cut,and table speed to an integrated HELID and grinding process controller 34 connected to the power source 18 and also connected to the electrolyte foil speed dressing gap 32. A method of using the HELID is also provided. When the grinding wheel 14 rotates and electrolytic fluid is supplied through a supply port 16 between the wheel surface 14 and the flexible electrode 12, hydrodynamic force allows the electrode 12 to wrap around the grinding wheel 14. As the flexible electrode 12 has its own loop and is free to travel or cycle, this force results in an increase in the foil speed. At the same time, a hydrodynamic thin film bearing is formed between the wheel surface 14 and the traveling electrode 12. The flexible electrode 12 may be rotated by a motor or by the hydrodynamic force of the electrolytic fluid 16. The flexible electrode 12 may be a foil or a flexure. The flexible electrode 12 may be used as a loop, but it is not necessary that the flexible electrode 12 forms a loop. If the flexible electrode 12 does not form a loop, the flexible electrode 12 does not rotate. The flexible electrode 12 wrapping around a portion of the surface of a grinding wheel 14 is used to establish and maintain a thin electrolytic film 16 between the wheel surface 14 and the foil electrode 12. A negative spinning terminal foil electrode 22 is used to connect the wheel 14 to the negative terminal of a power source 18. A positive spinning terminal foil electrode 24 is used to connect the wheel 14 to the positive terminal of the power source 18. Thus, the two foil electrodes with thin films 22 and 24, the wheel 14, and the power source 18 form a loop for dressing current flow. Because of the unique feature of the foil electrodes 22 and 24, the loop 12 is present even when the surface speed of the grinding wheel is very high. The levels of voltage and current as well as their wave forms and natures (DC or AC) are selected based upon the rate and quality of the dressing process and wheel wear during high speed grinding. The high speed electrolytic in-process dressing or HELID can be realized by using the device with electric power supplied to the wheel and the foils. The levels of voltage and current as well as their wave forms and natures (DC or AC) can be decided based on the rate and quality of a dressing process and wheel wear rate during high speed grinding.

In the present invention, a traveling foil electrode wrapping around a portion of the surface of the grinding wheel is used to establish and maintain a thin electrolytic film between the grinding wheel surface and the foil electrode. The resulting reduced relative speed between the wheel surface and the traveling foil electrode allows an electrolytic fluid film to be established. This allows high speed in-process dressing to occur. It is essential to have an electrolytic fluid film between the surface to be dressed and the electrode in order to realize the electrolytic in-process dressing. When the flexible electrode is present as a loop around a group of bearing rollers or preformed around the grinding wheel, as the wheel speed is increased the thickness of the hydrodynamic thin film between the wheel surface and the flexible electrode is automatically adjusted. Such a film is difficult to establish when a grinding wheel is running at a high speed relative to a fixed solid electrode, which is the reason why present ELID grinding is only effective at low speeds.

By improving electrolyte supply in the dressing zone, dressing efficiency is improved. Supply of sufficient electrolyte in the dressing zone allows a stable electrolyte film to cover the entire dressing zone. According to the Reynolds lubrication equation (Chi, "Hydromechanical Lubrication", *National Defense Press,* Sep. Beijing, 1998), the lubrication film is built by the dragging effects determined by wedge shape, the velocity of two surfaces and velocity gradient. Based upon this principle, a HELID electrode as shown in FIG. 1, is designed to build up an electrolyte film between the electrode and wheel surface. The development of the HELID technique can thus be realized. The dynamic characteristics of the HELID electrode come from its three special components, an electric connector, a dynamic cathode, and a cathode driver.

The effectiveness of the traveling foil electrode was evaluated. At a grinding wheel surface speed of 34.5 m/s, the improvement was 5 to 7 times as evidenced by the dressing current through a well established electrolytic fluid film.

According to Faraday's laws of electrolysis the amount of any substance dissolved or deposited is directly proportional to the amount of charge that has flowed; and the amounts of different substances dissolved or deposited by the same quantity of electricity are proportional to their chemical equivalent weights. The total theoretical volumetric material removal is given by (Bifano et al. 1995, Lee and Kim 1997):

$$\upsilon_{vol} = \frac{MIt}{zF\rho_{bond}} \text{ and } \frac{d\upsilon_{vol}}{dt} = \frac{MI}{zF\rho}$$

Where M is the atomic weight of the reacting ions; I is he current; t is the reaction time; z is the valence of the reacting ions; F is Faraday's constant; and $\rho_{bond}$ is the density of the metal bond. From the equation it is clear that the material removed from an anode is proportional to the current. The value of current indicates the strength of electrolysis. In this test, current values were used as a measure of electrolysis.

Tests were carried out using an ELID power supply-ED910. The electrolyte was a weak aqueous alkaline solution. The effectiveness of HELID electrode was compared to a traditional one at a high wheel speed in terms of initial dressing current. An aluminum wheel was used. The surface speed was 34.3 m/s. The values of current and voltage were taken to represent the initial dressing current and voltage.

The invention is further illustrated by the following, non-limiting examples.

EXAMPLE 1

This example shows the test results of the HELID electrode. A HELID electrode with a length of about ⅙ circumference of the wheel was tested under different output voltages and the data is shown in Table 1 below. The material of the electrode is stainless steel. The dressing current increases almost linearly with the increase of the output voltage, and more importantly, is very close to the value of the output current.

TABLE 1

| Output Voltage $V_p$, V | Output Current $I_p$, A | Dressing Voltage V, V | Dressing Current I, A |
|---|---|---|---|
| 30 | 1 | 10 | 0.5 |
| 40 | 1 | 14 | 0.7 |
| 50 | 1 | 18 | 0.9 |
| 60 | 1 | 20 | 1.1 (larger than $I_p$) |

EXAMPLE 2

This example shows the test results of the typical electrode. To make a comparison, data from use of a traditional electrode was compiled as shown in the table below. The traditional electrode has a length of ⅙ wheel circumference with a gap of 0.5 mm between the wheel and the electrode. The material of this electrode is also stainless steel and test conditions were the same as those of the HELID electrode described above. As shown in Table 2, the dressing current is very small and increases slowly. This means that the traditional electrode does not work well at a high wheel speed. The dressing current of the traditional electrode is much less compared to that of the HELID electrode.

TABLE 2

| Output Voltage $V_p$, V | Output Current $I_p$, A | Dressing Voltage V, V | Dressing Current I, A |
|---|---|---|---|
| 30 | 1 | 20 | 0.09 |
| 40 | 1 | 30 | 0.1 |
| 50 | 1 | 40 | 0.12 |
| 60 | 1 | 40 | 1.18 |

Further comparison of the dressing current and voltage between the HELID electrode and the traditional electrode demonstrates that the current of the HELID electrode is 4.55–6.5 times larger than that of the traditional electrode due to the improved supply of electrolyte between the electrode and the grinding wheel surface. For the HELID electrode, the gap between the electrode and the wheel surface is automatically established through hydrodynamic effect, which helps to build stable electrolyte film. The combination of these effects increased the dressing currents. In addition to supplying sufficient electrolyte in the dressing zone, the HELID electrode can also give a larger dressing area as a longer HELID electrode can remain effective. This is because it can deliver electrolyte much deeper into the dressing zone than traditional electrodes.

The HELID electrode can significantly increase the dressing current at a high wheel speed of 34.3 m/s. It is able to bring more electrolyte into the dressing zone due to its dynamic function. It is able to realize a dressing current 5.5–7.5 times that of a traditional electrode. It is able to self-adjust thereby saving time for gap adjustment. It has the ability to become longer to increase the dressing area due to its structure.

The above examples have been given only by way of illustration and are not intended to limit the scope of the present invention, which scope is defined below in the following claims.

What is claimed is:

1. A method for sharpening grinding wheels comprising:

rotating an electrical conductive bond grinding wheel at a selected speed; supplying electrolytic fluid between said electrical conductive bond grinding wheel surface and a flexible electrode; allowing said flexible electrode to wrap around said electrical conductive bond grinding wheel through hydrodynamic force; and forming a thin hydrodynamic film bearing between said electrical conductive bond grinding wheel surface and the flexible electrode.

2. The method of claim 1 wherein the flexible electrode forms a loop, and wherein as the wheel speed is increased the speed of the flexible electrode loop increases.

3. The method of claim 1 wherein as the wheel speed is increased the thickness of the hydrodynamic thin film between the wheel surface and the flexible electrode is automatically adjusted.

4. The method of claim 1 wherein the flexible electrode is preformed around the grinding wheel, and wherein as the wheel speed is increased the thickness of the hydrodynamic thin film between the wheel surface and the flexible electrode is automatically adjusted.

5. A device for high speed electrolytic in-process dressing (HELID) comprising an electrical conductive flexible electrode, an electrical conductive bond grinding wheel, an electrolytic fluid supply and a power source, wherein the electrical conductive flexible electrode forms a loop around at least one bearing roller.

6. The device of claim 5 wherein the flexible electrode is foil.

7. The device of claim 5 wherein the flexible electrode is flexure.

8. The device of claim 7 wherein the flexure is preformed around the electrical conductive bond grinding wheel.

9. The device of claim 5 wherein the flexible electrode is rotatable by a motor.

10. The device of claim 5 where the flexible electrode is actuated by a fast moving electrolytic fluid between the electrical conductive flexible electrode, and the electrical conductive bond grinding wheel.

11. A device for high speed electrolytic in-process dressing (HELID) comprising an electrical conductive flexible electrode, an electrical conductive bond grinding wheel, an electrolytic fluid supply and a power source, wherein the flexible electrode is foil, and wherein the foil electrode forms a loop around a group of bearing rollers.

* * * * *